US011892241B2

(12) United States Patent
Machida

(10) Patent No.: US 11,892,241 B2
(45) Date of Patent: Feb. 6, 2024

(54) LOOP HEAT PIPE WITH POROUS BODY FORMED FROM CONVEX HOLES

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 49 days.

(21) Appl. No.: 17/727,045

(22) Filed: Apr. 22, 2022

(65) Prior Publication Data

US 2022/0341679 A1 Oct. 27, 2022

(30) Foreign Application Priority Data

Apr. 26, 2021 (JP) ..... 2021-074035

(51) Int. Cl.
*F28D 15/00* (2006.01)
*F28D 15/04* (2006.01)

(52) U.S. Cl.
CPC ..... *F28D 15/043* (2013.01)

(58) Field of Classification Search
CPC ..... F28D 15/043; F28D 15/0266
See application file for complete search history.

(56) References Cited

U.S. PATENT DOCUMENTS

2018/0058767 A1 3/2018 Machida et al.
2018/0164043 A1 6/2018 Kurashima et al.
2019/0242652 A1 8/2019 Machida
2019/0293362 A1* 9/2019 Machida ..... F28D 15/0266
2020/0200485 A1 6/2020 Machida
2020/0378686 A1 12/2020 Machida et al.

FOREIGN PATENT DOCUMENTS

EP 3 524 911 A1 8/2019
JP 6291000 3/2018
JP 6400240 10/2018

OTHER PUBLICATIONS

Extended European search report dated Sep. 12, 2022 issued in corresponding European Application No. 22 16 9484; (5 pages).

* cited by examiner

*Primary Examiner* — Travis Ruby
(74) *Attorney, Agent, or Firm* — Rankin, Hill & Clark LLP

(57) ABSTRACT

At least one of an evaporator, a condenser, a liquid pipe, and a vapor pipe includes a first outer metal layer, a second outer metal layer, and an inner metal layer including a porous body. The porous body includes a first bottomed hole formed in one face of the inner metal layer; a second bottomed hole formed in the other face of the inner metal layer; a pore, and a first convex portion provided inside the first bottomed hole. The first convex portion has a proximal end connected to a bottom face of the first bottomed hole and a distal end provided on an opposite side to the proximal end in a thickness direction of the first convex portion. The distal end is provided at a position further recessed toward the bottom face of the first bottomed hole than the one face of the inner metal layer.

9 Claims, 10 Drawing Sheets

LOOP HEAT PIPE WITH POROUS BODY FORMED FROM CONVEX HOLES

CROSS-REFERENCE TO RELATED APPLICATIONS

This application claims priority from Japanese Patent Applications No. 2021-074035, filed on Apr. 26, 2021, the entire contents of which are herein incorporated by reference.

TECHNICAL FIELD

The present invention relates to a loop heat pipe.

BACKGROUND ART

In the related art, as a device configured to cool a heat-generating component of a semiconductor device (for example, a CPU or the like) mounted on an electronic device, a heat pipe configured to transport heat by utilizing a phase change of a working fluid is suggested (for example, refer to PTLs 1 and 2).

As an example of the heat pipe, known is a loop heat pipe including an evaporator configured to vaporize a working fluid by heat of a heat-generating component and a condenser configured to cool and condense the vaporized working fluid, wherein the evaporator and the condenser are connected by a liquid pipe and a vapor pipe configured to form a loop-like flow channel. In the loop heat pipe, the working fluid flows in one direction in the loop-like flow channel.

The flow channel is formed by laminating a plurality of metal layers. The plurality of metal layers has a pair of outer metal layers provided at both ends in a laminating direction of the plurality of metal layers, and a plurality of inner metal layers provided between the pan of outer metal layers. The plurality of inner metal layers is provided with a porous body having a fine pore formed by partially communicating a bottomed hole recessed from one face of each inner metal layer and a bottomed hole recessed from the other face of each inner metal layer. One end-side of the inner metal layer in the laminating direction is bonded to one outer metal layer, and the other end-side of the inner metal layer in the laminating direction is bonded to the other outer metal layer.

CITATION LIST

Patent Literature

PTL 1: Japanese Patent No. 6,291,000
PTL 2: Japanese Patent No. 6,400,240

SUMMARY OF INVENTION

However, in the loop heat pipe, volume expansion may occur when the working fluid of a liquid phase is vaporized, depending on a characteristic of the working fluid sealed in the flow channel. Further, in the loop heat pipe, when an ambient temperature of the loop heat pipe becomes lower than a freezing point of the working fluid, the working fluid freezes and solidifies. At this time, volume expansion may occur as the working fluid undergoes a phase change from a liquid phase to a solid phase. When such volume expansion occurs, the outer metal layer is deformed to bulge outward, so that the outer metal layer may be peeled off from the inner metal layer.

Certain embodiment provides a loop heat pipe.

The loop heat pipe comprises:

an evaporator that vaporizes a working fluid;

a condenser that condenses the working fluid;

a liquid pipe that connects the evaporator and the condenser to each other;

a vapor pipe that connects the evaporator and the condenser to each other, and a loop-like flow channel that is provided in each of the evaporator, the condenser, the liquid pipe, and the vapor pipe, and through which the working fluid flows, wherein at least one of evaporator, the condenser, the liquid pipe and the vapor pipe comprises a first outer metal layer, a second outer metal layer, and an inner metal layer that is provided between the first outer metal layer and the second outer metal layer, and the inner metal layer comprises a porous body, wherein the porous body comprises a first bottomed hole formed in one face of the inner metal layer, a second bottomed hole firmed in the other face of the inner metal layer, a pore, wherein the first bottomed hole and the second bottomed hole partially communicates with each other through the pore, and a first convex portion provided inside the first bottomed hole, wherein the first convex portion has a proximal end connected to a bottom face of the first bottomed hole and a distal end provided on an opposite side to the proximal end in a thickness direction of the first convex portion, and the distal end of the first convex portion is provided at a position further recessed toward the bottom face of the first bottomed hole than the one face of the inner metal layer.

According to one aspect of the present invention, it is possible to obtain an effect capable of suppressing peel-off of the outer metal layer.

DESCRIPTION OF EMBODIMENTS

Figure 1:
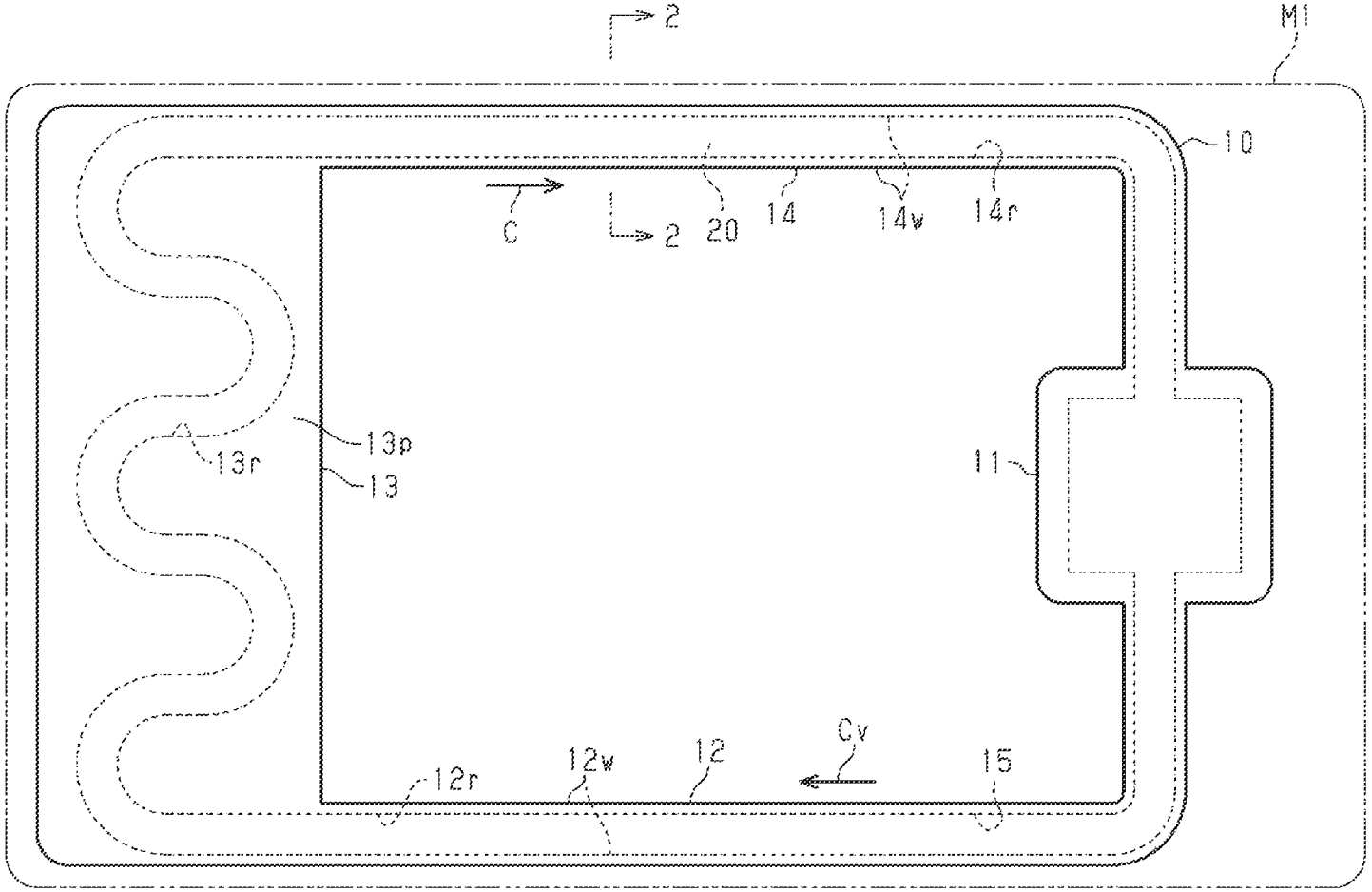
FIG. 1 is a schematic plan view showing a loop heat pipe of one embodiment.

Hereinafter, one embodiment will be described with reference to the accompanying drawings.

Note that, for convenience sake, in the accompanying drawings, a characteristic part is enlarged so as to easily understand the feature, and the dimension ratios of the respective constitutional elements may be different in the respective drawings. Further, in the sectional views, hatching of some members is shown in a satin form, and hating of some members is omitted so as to easily understand a sectional structure of each member. Note that, in the present specification, 'in plan view' means seeing an object from a vertical direction (an upper and lower direction in the drawings) in FIG. 2A and the like, and 'planar shape' means a shape of an object seen from the vertical direction in FIG. 2A and the like. Further, in the present specification, the 'upper and lower direction' and the 'right and left direction' are directions when a direction in which the reference numeral indicating each member can be correctly read in each drawing is set as the normal position.

Overall Configuration of Loop Heat Pipe 10

A loop heat pipe 10 shown in FIG. 1 is accommodated in a mobile electronic device M1 such as a smart phone and a tablet terminal. The loop heat pipe 10 has an evaporator 11, a vapor pipe 12, a condenser 13, and a liquid pipe 14.

The evaporator 11 and the condenser 13 are connected by the vapor pipe 12 and the liquid pipe 14. The evaporator 11 has a function of vaporizing a working fluid C to generate steam Cv. The steam Cv generated in the evaporator 11 is sent to the condenser 13 via the vapor pipe 12. The condenser 13 has a function of condensing the steam Cv of the working fluid C. The liquefied working fluid C is sent to the evaporator 11 via the liquid pipe 14. The vapor pipe 12 and the liquid pipe 14 are configured to form a loop-like flow channel 15 through which the working fluid C or the steam Cv is caused to flow.

The vapor pipe 12 is formed, for example, by an elongated pipe body. The liquid pipe 14 is formed, for example, by an elongated pipe body. In the present embodiment, the vapor pipe 12 and the liquid pipe 14 are the same in dimension (i.e., length) in a length direction, for example. Note that, the length of the vapor pipe 12 and the length of the liquid pipe 14 may also be different from each other. For example, the length of the vapor pipe 12 may also be shorter than the length of the liquid pipe 14. Here, in the present specification, the 'length direction' of the evaporator 11, the vapor pipe 12, the condenser 13 and the liquid pipe 14 is a direction that coincides with a direction (refer to an arrow in the drawing) in which the working fluid C or steam Cv flows in each member.

Configuration of Evaporator 11

The evaporator 11 is closely fixed to a heat-generating component (not shown). The working fluid C in the evaporator 11 is vaporized by heat generated by the heat-generating component, and steam Cv is accordingly generated. Note that, a thermal conduction member (TIM: Thermal Interface Material) may also be interposed between the evaporator 11 and the heat-generating component. The thermal conduction member is configured to reduce a contact thermal resistance between the heat-generating component and the evaporator 11 and to smooth heat conduction from the heat-generating component to the evaporator 11.

Configuration of Vapor Pipe 12

The evaporator 12 has a pair of pipe walls 12*w* provided on both sides in a width direction orthogonal to the length direction of the evaporator 12, in plan view, and a flow channel 12*r* provided between the pair of pipe walls 12*w*, for example. The flow channel 12*r* is formed to communicate with an internal space of the evaporator 11. The flow channel 12*r* is a part of the loop-like flow channel 15. The steam Cv generated in the evaporator 11 is introduced into the condenser 13 via the vapor pipe 12.

Configuration of Condenser 13

The condenser 13 has a heat radiation plate 13*p* whose area is increased for heat radiation, and a serpentine flow channel 13*r* in the heat radiation plate 13*p*, for example. The flow channel 13*r* is a part of the loop-like flow channel 15. The steam Cv introduced via the vapor pipe 12 is liquefied in the condenser 13.

Configuration of Liquid Pipe 14

The liquid pipe 14 has a pair of pipe walls 14*w* provided on both sides in the width direction orthogonal to the length direction of the liquid pipe 14, in plan view, and a flow channel 14*r* provided between the pair of pipe walls 14*w*, for example. The flow channel 14*r* is formed to communicate with the flow channel 13*r* of the condenser 13 and the internal space of the evaporator 11. The flow channel 14*r* is a part of the loop-like flow channel 15.

The liquid pipe 14 has a porous body 20. The porous body 20 is formed to extend from the condenser 13 to the evaporator 11 along the length direction of the liquid pipe 14, for example. The porous body 20 is configured to guide the working fluid C liquefied in the condenser 13 to the evaporator 11 by a capillary force generated in the porous body 20. That is, the working fluid C liquefied in the condenser 13 is guided to the evaporator 11 through the liquid pipe 14. Note that, although not shown, a porous body similar to the porous body is also provided in the evaporator 11.

Configuration of Loop Heat Pipe 10

In this way, in the loop heat pipe 10, the heat generated by the heat-generating component is transferred to the condenser 13 and radiated in the condenser 13. Thereby, the heat-generating component is cooled, and the temperature rise of the heat-generating component is suppressed.

Here, as the working fluid C, a fluid having a high vapor pressure and a high latent heat of vaporization is preferably used. By using such working fluid C, it is possible to effectively cool the heat-generating component by the latent heat of vaporization. As the working fluid C, ammonia, water, freon, alcohol, acetone and the like can be used, for example.

Specific Structure of Liquid Pipe 14

Figure 2A:
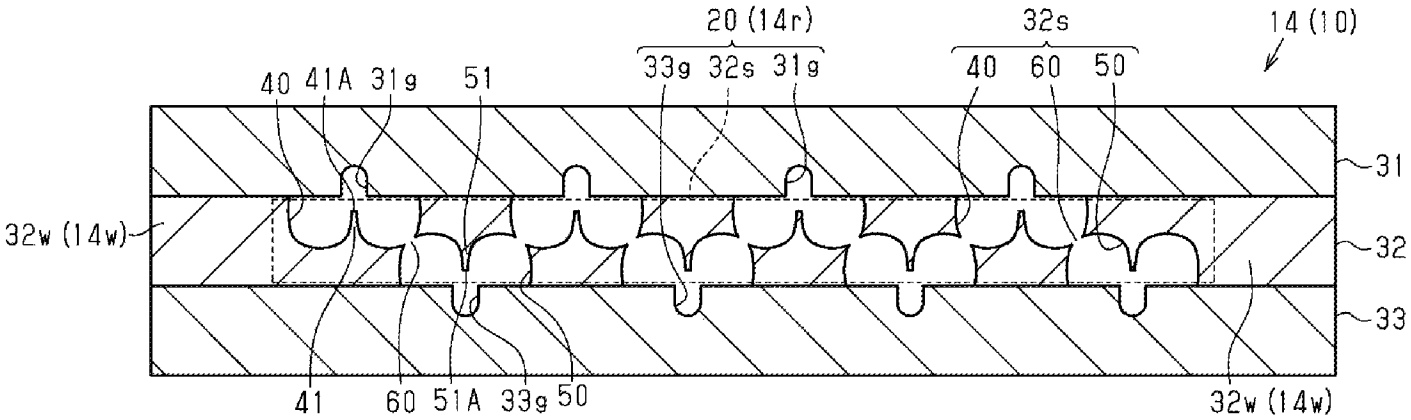
FIG. 2A is a schematic sectional view (a sectional view taken along a line 2-2 in FIG. 1) showing a liquid pipe of one embodiment.
Figure 2B:
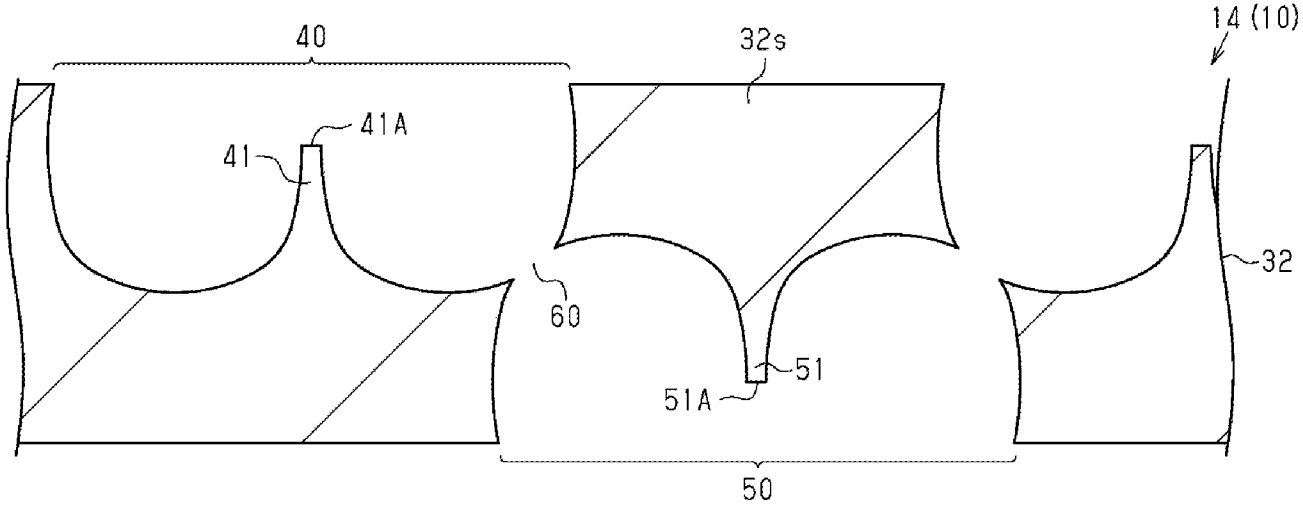
FIG. 2B is an enlarged sectional view of a part of the liquid pipe shown in FIG. 2A.

FIG. 2A shows a section of the liquid pipe 14 taken along a line 2-2 of FIG. 1. The section is a face orthogonal to a direction (direction denoted with an arrow in FIG. 1) in which the working fluid C flows in the liquid pipe 14. FIG. 2B is an enlarged sectional view of a pail of the liquid pipe 14 shown in FIG. 2A.

As shown in FIG. 2A, the liquid pipe 14 has a structure where metal layers 31, 32 and 33 of three layers, for example, are laminated. In other words, the liquid pipe 14 has a structure where the metal 32, which is an inner metal layer, is laminated between the metal layers 31 and 33, which are a pair of outer metal layers. The inner metal layer of the liquid pipe 14 of the present embodiment is configured by only one metal layer 32.

Each of the metal layers 31 to 33 is a copper (Cu) layer having excellent thermal conductivity. The plurality of metal layers 31 to 33 is directly bonded to each other by solid-phase bonding such as diffusion joining, pressure welding, friction pressure welding and ultrasonic joining. Note that, in FIG. 2, the metal layers 31 to 33 are identified by solid lines for easy understanding. For example, when the metal layers 31 to 33 are integrated by diffusion joining, interfaces of the respective metal layers 31 to 33 may be lost and boundaries may not be clear, in some cases. As used herein, the solid-phase bonding is a method of heating and softening joining targets in a solid-phase (solid) state without melting the same, and then further heating, plastically deforming and joining the joining targets. Note that, the metal layers 31 to 33 are not limited to the copper layers and may also be formed of stainless steel, aluminum, magnesium alloy or the like. In addition, for some of the laminated metal layers 31 to 33, a material different from the other metal layers may also be used. A thickness of each of the metal layers 31 to 33 may be set to about 50 μm to 200 μm, for example. Note that, some of the metal layers 31 to 33 may be formed to have a thickness different from the other metal layers, and all the metal layers may be formed to have thicknesses different from each other.

The liquid pipe 14 is configured by the laminated metal layers 31 to 33, and has a pair of pipe walls 14*w* provided at both ends in a width direction (a right and left direction in FIG. 2A) of the liquid pipe 14 orthogonal to the laminating direction of the metal layers 31 to 33, and a porous body 20 provided between the pair of pipe walls 14*w* The porous body 20 is formed to be continuous with, for example, the pipe walls 14*w*.

The metal layer 31 is laminated on an upper face of the metal layer 32. A lower face of the metal layer 31 is formed with one or more grooves 31*g*. Each groove 31*g* is formed to be recessed from the lower face of the metal layer 31 to a central portion in a thickness direction of the metal layer 31.

The metal layer 32 is laminated between the metal layer 31 and the metal layer 33. The upper face of the metal layer 31 is bonded to the lower face of the metal layer 31. A lower face of the metal layer 32 is bonded to an upper face of the metal layer 33. The metal layer 32 has a pair of wall portions 32*w* provided at both ends in the width direction of the liquid pipe 14 and a porous body 32*s* provided between the pair of wall portions 32*w*.

The metal layer 33 is laminated on the lower face of the metal layer 32. The upper face of the metal layer 33 is formed with one or more grooves 33*g*. Each groove 33*g* is formed to be recessed from the upper face of the metal layer 33 to a central portion in a thickness direction of the metal layer 33.

Specific Structure of Pipe Wall 14*w*

The pipe wall 14*w* is configured by, for example, a wall portion 32*w* of the metal layer 32 that is an inner metal layer. Each pipe wall 14*w* of the present embodiment is configured by only the wall portion 32*w*. Each wall portion 32*w* is not formed with a hole or a groove.

Specific Structure of Porous Body 20

The porous body 20 has, for example, the porous body 32*s* of the metal layer 32, which is the inner metal layer, and the grooves 31*g* and 33*g* of the metal layers 31 and 33, which are the outer metal layers.

Specific Structure of Porous Body 32*s*

The porous body 32*s* has a bottomed hole 40 recessed from the upper face of the metal layer 32 to the central portion in the thickness direction of the metal layer 32, and a bottomed hole 50 recessed from the lower face of the metal layer 32 to the central portion in the thickness direction of the metal layer 32. The porous body 32*s* has a pore 60 formed by partially communicating the bottomed hole 40 and the bottomed hole 50. A depth of each of the bottomed holes 40 and 50 may be set to about 25 μm to 100 μm, for example.

As shown in FIG. 2B, an inner face of each of the bottomed holes 40 and 50 is formed in a shape continuing in an arc shape from an opening-side (upper and lower faces-side of the metal layer 32) to a bottom face, for example. The inner face of each of the bottomed holes 40 and 50 is formed to have a curved face curved in an arc shape in a sectional view. The sectional shape of each of the inner faces of the bottomed holes 40 and 50 is formed, for example, in a curved face curved in an arc shape so that an opening width in the middle of the bottomed holes 40 and 50 in a depth direction is widest. The bottom face of each of the bottomed holes 40 and 50 is formed in a curved face curved in an arc shape in a sectional view. The bottom face of each of the bottomed holes 40 and 50 is formed to be continuous with the inner face of each of the bottomed holes 40 and 50, for example. A radius of curvature of the bottom face of each of the bottomed holes 40 and 50 may be the same as a radius of curvature of the inner face of each of the bottomed holes 40 and 50, or may be different from the radius of curvature of the inner face of each of the bottomed holes 40 and 50. As used herein, in the present specification, the 'same' includes not only a case where comparison targets are exactly the same but also a case where there is a slight difference between the comparison targets due to influences of dimensional tolerances and the like.

Note that, the inner face of each of the bottomed holes 40 and 50 may be formed in a concave shape having a semi-circular or semi-elliptical sectional shape. As used herein, in the present specification, the 'semi-circular shape' includes not only a semicircle obtained by bisecting a true circle, but also, for example, one having an arc longer or shorter than the semicircle. In addition, in the present specification, the 'semi-elliptical shape' includes not only a semi-ellipse obtained by bisecting an ellipse, but also, for example, one having an arc longer or shorter than the semi-ellipse. Further, the inner face of each of the bottomed holes 40 and 50 may be formed in a tapered shape that expands from the bottom face toward the opening-side. Further, the bottom face of each of the bottomed holes 40 and 50 may be formed to be a plane parallel to the upper face of the metal layer 32, and the inner side face of each of the bottomed holes 40 and 50 may be formed to extend perpendicularly to the bottom face.

Figure 3:
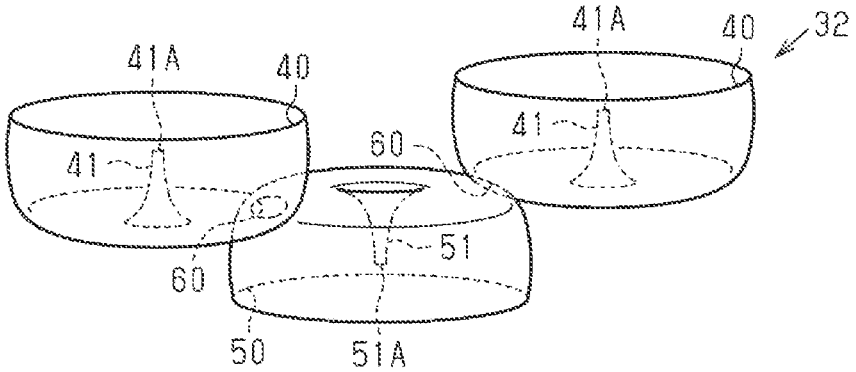
FIG. 3 is a schematic perspective view showing a porous body of one embodiment.
Figure 4:
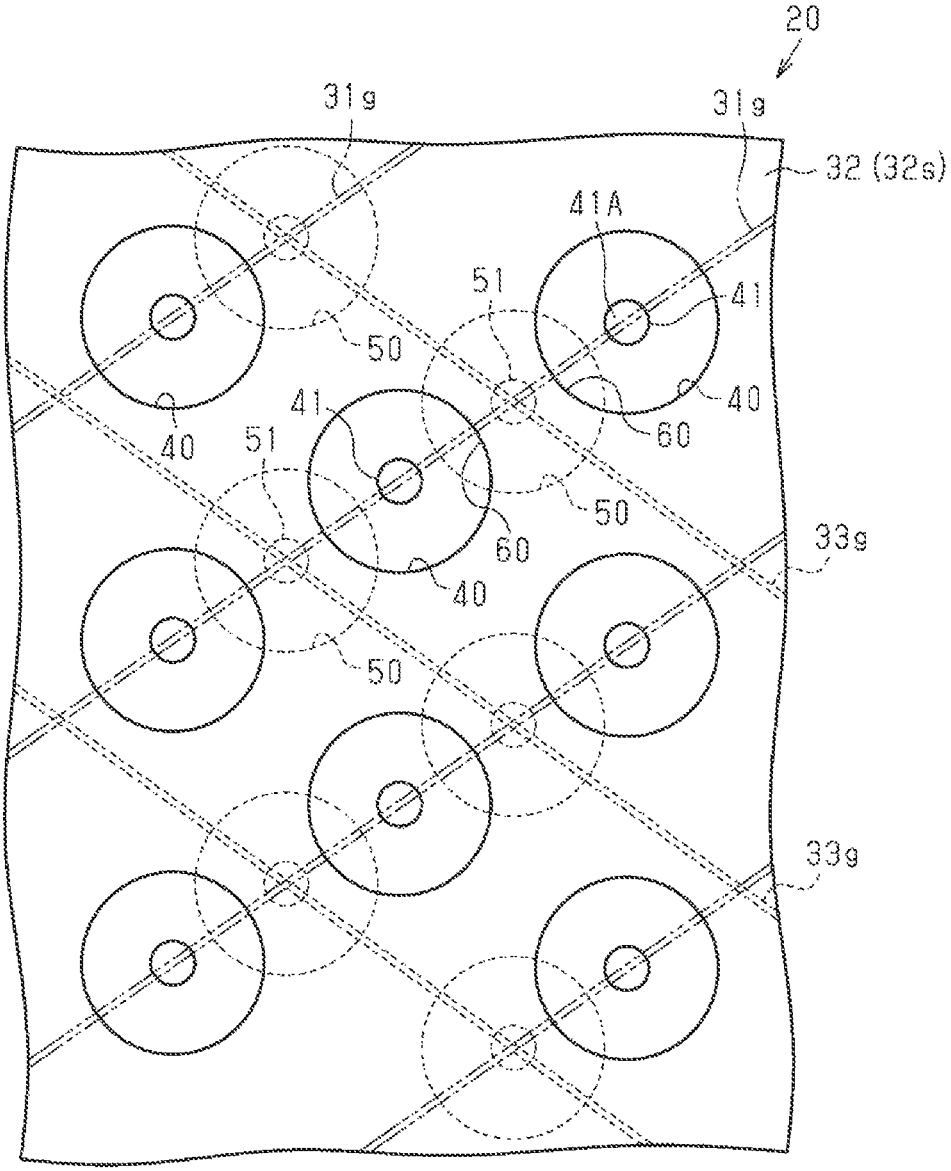
FIG. 4 is a schematic plan view showing the porous body of one embodiment.

As shown in FIGS. 3 and 4, the bottomed holes 40 and 50 are each formed in a circular shape in plan view, for example. A diameter of each of the bottomed holes 40 and 50 may be set to about 100 μm to 400 μm, for example. Note that, the planar shape of each of the bottomed holes 40 and 50 can be formed in an arbitrary shape such as an ellipse or a polygon. The bottomed hole 40 and the bottomed hole 50 partially overlap in plan view. In the portion Where the bottomed hole 40 and the bottomed hole 50 overlap in plan view, the bottomed hole 40 and the bottomed hole 50 partially communicate with each other to form the pore 60. Note that, FIG. 3 shows only the portion of the metal layer 32, which constitutes the porous body 32*s* (the bottomed holes 40 and 50 and the pores 60).

Specific Structure of Bottomed Hole 40

The bottomed hole 40 has therein a convex portion 41. That is, the metal layer 32 has a convex portion 41 provided in the bottomed hole 40. The convex portion 41 is formed continuously and integrally with the metal layer 32 constituting the bottom face of the bottomed hole 40, for example. The convex portion 41 is provided, for example, apart from an entire circumference of the inner face of the bottomed hole 40. That is, a space is formed over the entire circumference of the bottomed hole 40 between an outer circumferential face of the convex portion 41 and the inner face of the bottomed hole 40. In other words, the convex portion 41 is provided at a central portion of the bottomed hole 40, in plan view. As shown in FIG. 4, the convex portion 41 of the present embodiment is provided at a center of the bottomed hole 40, in plan view. The convex portion 41 is provided, for example, at a position that does not overlap the entire bottomed hole 50, in plan view.

A planar shape of the convex portion 41 can be formed to have arbitrary shape and size. The planar shape of the convex portion 41 may be the same as the planar shape of the bottomed hole 40, or may be different from the planar shape of the bottomed hole 40. The size of the planar shape of the convex portion 41 can be set to about 5% to 20% of a size of the planar shape of the bottomed hole 40, for example. For example, the planar shape of the convex portion 41 can be formed in a circular shape having a diameter of about 5 μm to 50 μm. In the present embodiment, the convex portion 41 is formed concentrically with the inner face of the bottomed hole 40.

As shown in FIG. 2B, the convex portion 41 has a proximal end and a distal end in a thickness direction of the convex portion 41. The proximal end of the convex portion 41 is connected to the bottom face of the bottomed hole 40. The distal end of the convex portion 41 is provided on an opposite side to the proximal end in the thickness direction of the convex portion 41. The distal end of the convex portion 41 has, for example, a distal end face 41A formed into a flat face. The convex portion 41 extends from the bottom face of the bottomed hole 40 to the middle in the depth direction of the bottomed hole 40, in the thickness direction (upper and lower direction in the drawing) of the metal layer 32. That is, a thickness of the convex portion 41 is set to a length shorter than the depth of the bottomed hole 40. The distal end face 41A of the convex portion 41 is provided at a position further recessed toward the bottom face (here, downward) of the bottomed hole 40 than the upper face (one face) of the metal layer 32. In the thickness direction of the convex portion 41, a distance between the distal end face 41A of the convex portion 41 and the bottom face of the bottomed hole 40 is smaller than a distance between the upper face of the metal layer 32 and the bottom face of the bottomed hole 40.

The convex portion 41 is formed, for example, in a tapered shape that tapers from the proximal end of the convex portion 41 toward the distal end of the convex portion 41. In other words, the convex portion 41 is formed to be thicker from the distal end face 41A of the convex portion 41 toward the bottom face of the bottomed hole 40. An outer circumferential face of the convex portion 41 is formed, for example, in a curved face curved in an arc shape, in a sectional view.

Note that, the convex portion 41 may also be formed so that a central portion in the thickness direction of the convex portion 41 is thinner than the proximal end and the distal end of the convex portion 41. That is, the convex portion 41 may also be formed so that the central portion in the thickness direction of the convex portion 41 is thinnest. In this case, a sectional shape of the outer circumferential face of the convex portion 41 is curved to have a 'constriction' at the central portion in the thickness direction of the convex portion 41. In this case, the outer circumferential face of the convex portion 41 is formed in a curved face curved in an arc shape, in a sectional view. In this case, the convex portion 41 is formed to be thicker from the central portion in the thickness direction of the convex portion 41 toward the distal end of the convex portion 41. In this case, the convex portion 41 is formed to be thicker from the central portion in the thickness direction of the convex portion 41 toward the proximal end of the convex portion 41.

Specific Structure of Bottomed Hole 50

The bottomed hole 50 has therein a convex portion 51. That is, the metal layer 32 has a convex portion 51 provided in the bottomed hole 50. The convex portion 51 is formed continuously and integrally with the metal layer 32 constituting the bottom face of the bottomed hole 50, for example. The convex portion 51 is provided, for example, apart from an entire circumference of the inner face of the bottomed hole 50. That is, a space is formed over the entire circumference of the bottomed hole 50 between an outer circumferential face of the convex portion 51 and the inner face of the bottomed hole 50. In other words, the convex portion 51 is provided at a central portion of the bottomed hole 50, in plan view. As shown in FIG. 4, the convex portion 51 of the present embodiment is provided at a center of the bottomed hole 50, in plan view. The convex portion 51 is provided, for example, at a position that does not overlap the entire bottomed hole 40, in plan view.

A planar shape of the convex portion 51 can be formed to have arbitrary shape and size. The planar shape of the convex portion 51 may be the same as the planar shape of the bottomed hole 50, or may be different from the planar shape of the bottomed hole 50. The size of the planar shape of the convex portion 51 can be set to about 5% to 20% of a size of the planar shape of the bottomed hole 50, for example. For example, the planar shape of the convex portion 51 can be formed in a circular shape having a diameter of about 5 μm to 50 μm. In the present embodiment, the convex portion 51 is formed concentrically with the inner face of the bottomed hole 50.

As shown in FIG. 2B, the convex portion 51 has a proximal end and a distal end in a thickness direction of the convex portion 51. The proximal end of the convex portion 51 is connected to the bottom face of the bottomed hole 50. The distal end of the convex portion 51 is provided on an opposite side to the proximal end in the thickness direction of the convex portion 51. The distal end of the convex portion 51 has, for example, a distal end face 51A formed into a flat face. The convex portion 51 extends from the bottom face of the bottomed hole 50 to the middle in the depth direction of the bottomed hole 50, in the thickness direction (upper and lower direction in the drawing) of the metal layer 32. That is, a thickness of the convex portion 51 is set to a length shorter than the depth of the bottomed hole 50. The distal end face 51A of the convex portion 51 is provided at a position further recessed toward the bottom face (here, upward) of the bottomed hole 50 than the lower face (other face) of the metal layer 32. In the thickness direction of the convex portion 51, a distance between the distal end face 51A of the convex portion 51 and the bottom face of the bottomed hole 50 is smaller than a distance between the lower face of the metal layer 32 and the bottom face of the bottomed hole 50.

The convex portion 51 is formed, for example, in a tapered shape that tapers from the proximal end of the convex portion 51 toward the distal end of the convex portion 51. In other words, the convex portion 51 is firmed to be thicker from the distal end face 51A of the convex portion 51 toward the bottom face of the bottomed hole 50. An outer circumferential face of the convex portion 51 is formed, for example, in a curved face curved in an arc shape, in a sectional view.

Note that, the convex portion 51 may also be formed so that a central portion in the thickness direction of the convex portion 51 is thinner than the proximal end and the distal end of the convex portion 51. That is, the convex portion 51 may also be formed so that the central portion in the thickness direction of the convex portion 51 is thinnest. In this case, a sectional shape of the outer circumferential face of the convex portion 51 is curved to have a 'constriction' at the central portion in the thickness direction of the convex portion 51. In this case, the outer circumferential face of the convex portion 51 is formed in a curved face curved in an arc shape, in a sectional view. In this case, the convex portion 51 is formed to be thicker from the central portion in the thickness direction of the convex portion 51 toward the distal end of the convex portion 51. In this case, the convex portion 51 is formed to be thicker from the central portion in the thickness direction of the convex portion 51 toward the proximal end of the convex portion 51.

As shown in FIG. 2A, the distal end face 41A of the convex portion 41 is provided apart from the lower face of the metal layer 31. A gap is formed between the distal end face 41A of the convex portion 41 and the lower face of the metal layer 31. The distal end face 51A of the convex portion 51 is provided apart from the upper face of the metal layer 33. A gap is formed between the distal end face 51A of the convex portion 51 and the upper face of the metal layer 33.

Specific Structures of Grooves 31*g* and 33*g*

A sectional shape of an inner face of each of the grooves 31*g* and 33*g* can be formed in an arbitrary shape. A bottom face of each of the grooves 31*g* and 33*g* is formed, for example, in a curved face curved in an arc shape. The inner face of each of the grooves 31*g* and 33*g* is formed to extend perpendicularly to the lower face of the metal layer 31, for example. Note that, the inner face of each of the grooves 31*g* and 33*g* may also be formed in a tapered shape that expands from the bottom face toward the opening-side. The inner face of each of the grooves 31*g* and 33*g* may also be formed in a shape continuing in an arc shape from the opening-side toward the bottom face. The inner face of each of the grooves 31*g* and 33*g* may also be formed in a concave shape becoming a semi-circular shape or a semi-elliptical shape.

As shown in FIG. 4, each groove 31*g* is provided at a position overlapping a portion of the bottomed hole 40, in plan view. Each groove 31*g* is formed to communicate with the bottomed hole 40. Each groove 31*g* is formed to communicate the plurality of adjacent bottomed holes 40 each other. Each groove 31*g* is formed to extend along a direction in which the plurality of bottomed holes 40 is aligned, in plan view. The plurality of grooves 31*g* is formed to extend in parallel to each other, for example. Each groove 31*g* is provided, for example, at a position overlapping the convex portion 41, in plan view. Each groove 31*g* is provided, for example, at a position overlapping a center of the bottomed hole 40, in plan view.

Each groove 33*g* is provided at a position overlapping a portion of the bottomed hole 50, in plan view Each groove 33*g* is formed to communicate with the bottomed hole 50. Each groove 33*g* is formed to communicate the plurality of adjacent bottomed holes 50 each other. Each groove 33*g* is formed to extend along a direction in which the plurality of bottomed holes 50 is aligned, in plan view. The plurality of grooves 33*g* is formed to extend in parallel to each other, for example. Each groove 33*g* is formed to extend in a direction intersecting with the groove 31*g*, in plan view, for example. Each groove 33*g* is provided, for example, at a position overlapping the convex portion 51, in plan view. Each groove 33*g* is provided for example, at a position overlapping a center of the bottomed hole 50, in plan view.

Configuration of Porous Body 20

As shown in FIG. 2A, the bottomed holes 40 and 50 and the pores 60 formed in the metal layer 32 and the grooves 31*g* and 33*g* respectively formed in the metal layers 31 and 33 communicate with each other. A space formed by communicating the bottomed holes 40 and 50, the pores 60 and the grooves 31*g* and 33*a* is three-dimensionally expanded. The bottomed holes 40, 50, the pores 60, and the grooves 31*g* and 33*g*, i.e., a flow channel of the porous body 20 functions as a flow channel 14*r* through which the working fluid C (refer to FIG. 1) of the liquid phase flows.

Although not shown, the liquid pipe 14 is provided with an injection port for injecting the working fluid C (refer to FIG. 1). However, the injection port is closed by a sealing member, so that an inside of the loop heat pipe 10 is kept airtight.

Configuration of Loop Heat Pipe 10

The evaporator 11, the vapor pipe 12, and the condenser 13 shown in FIG. 1 are formed by three laminated metal layers 31 to 33 (refer to FIG. 2A), like the liquid pipe 14 shown in FIG. 2A. That is, the loop heat pipe 10 shown in FIG. 1 is configured by laminating three metal layers 31 to 33 (refer to FIG. 2A). For example, in the evaporator 11, a porous body provided in the evaporator 11 is formed in a comb-teeth shape. In the evaporator 11, a region in which the porous body is not provided has a space. For example, in the vapor pipe 12, the flow channel 12*r* is formed by forming a through hole penetrating through the metal layer 32 (refer to FIG. 2A), which is an inner metal layer, in the thickness direction. For example, in the condenser 13, the flow channel 13*r* is formed by forming a through hole penetrating through the metal layer 32 (refer to FIG. 2A), which is an inner metal layer, in the thickness direction. Note that, the number of the laminated metal layers is not limited to 3 layers, and may be 4 or more layers.

Operations of Loop Heal Pipe 10

Next, operations of the loop heat pipe 10 are described.

The loop heat pipe 10 includes the evaporator 11 configured to vaporize the working fluid C, the vapor pipe 12 configured to cause the vaporized working fluid C (that is, steam Cv) to flow into the condenser 13, the condenser 13 configured to condense the steam Cv, and the liquid pipe 14 configured to cause the liquefied working fluid C to flow into the evaporator 11.

The liquid pipe 14 is provided with the porous body 20. The porous body 20 extends from the condenser 13 to the evaporator 11 along the length direction of the liquid pipe 14. The porous body 20 guides the working fluid C of the liquid phase liquefied in the condenser 13 to the evaporator 11 by a capillary force generated in the porous body 20.

Here, as shown in FIG. 2A, in the liquid pipe 14, the convex portion 41 is provided in the bottomed hole 40 formed in the metal layer 32 that is the inner metal layer, and the convex portion 51 is provided in the bottomed hole 50 formed in the metal layer 32. Thereby, volumes of the bottomed holes 40 and 50 can be reduced, as compared to a case where the convex portions 41 and 51 are not provided, so that an amount of the working fluid C stored in the bottomed holes 40 and 50 can be reduced. Therefore, for example, when a volume expansion occurs as the working fluid C flowing in the liquid pipe 14 undergoes a phase change from a liquid phase to a solid phase, an amount of the volume expansion can be reduced, as compared to the case where the convex portions 41 and 51 are not provided.

In the present embodiment, the metal layer 31 is an example of the first outer metal layer, the metal layer 32 is an example of the inner metal layer, and the metal layer 33 is an example of the second outer metal layer. In addition, the bottomed hole 40 is an example of the first bottomed hole, the convex portion 41 is an example of the first convex portion, the bottomed hole 50 is an example of the second bottomed hole, the convex portion 51 is an example of the second convex portion, the groove 31*g* is an example of the first groove, and the groove 33*g* is an example of the second groove.

Manufacturing Method of Loop Heat Pipe 10

Next, a manufacturing method of the loop heat pipe 10 is described.

Figure 5A:
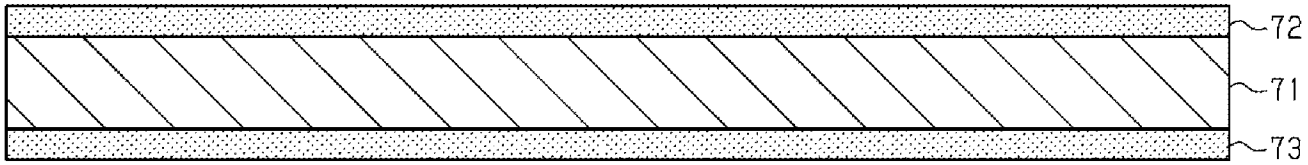
FIGS. 5A to 5D are schematic sectional views showing a manufacturing method of a loop heat pipe of one embodiment.

First, in a process shown in FIG. 5A, a flat plate-like metal sheet 71 is prepared. The metal sheet 71 is a member that finally becomes the metal layer 31 (refer to FIG. 2A). The metal sheet 71 is made of, for example, copper, stainless steel, aluminum, a magnesium alloy, or the like. A thickness of the metal sheet 71 may be set to about 50 μm to 200 μm, for example.

Subsequently, a resist layer 72 is formed on an upper face of the metal sheet 71, and a resist layer 73 is formed on a lower face of the metal sheet 71. As the resist layers 72 and 73, for example, a photosensitive dry film resist or the like can be used.

Figure 5B:
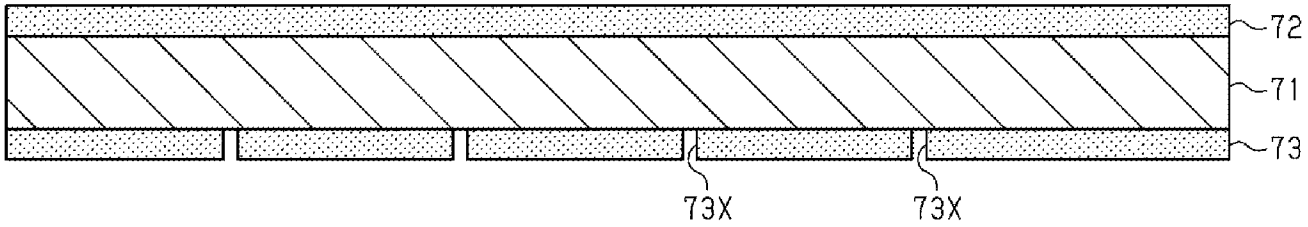

Next, in a process shown in FIG. 5B, the resist layer 73 is exposed and developed to form opening portions 73X for selectively exposing the lower face of the metal sheet 71. The opening portions 73X are formed to correspond to the grooves 31*g* shown in FIG. 2A.

Figure 5C:
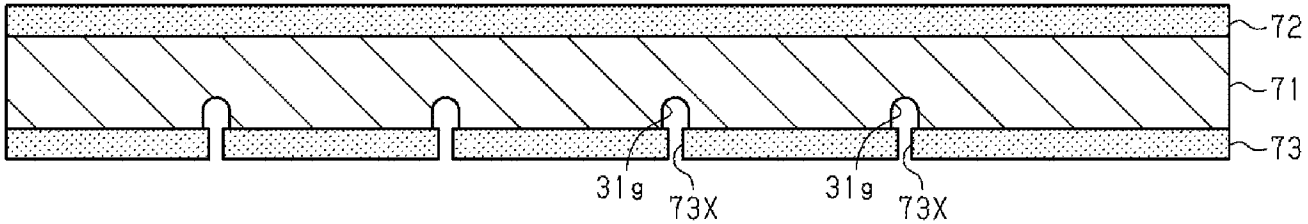

Subsequently, in a process shown in FIG. 5C, the metal sheet 71 exposed in the opening portions 73X is etched from the lower face-side of the metal sheet 71. Thereby, the lower face of the metal sheet 71 is formed with grooves 31*g*. The grooves 31*g* can be formed by, for example, wet-etching the metal sheet 71 by using the resist layers 72 and 73 as an etching mask. When copper is used as the material of the metal sheet 71, a ferric chloride aqueous solution or a copper chloride aqueous solution can be used as an etching solution.

Figure 5D:
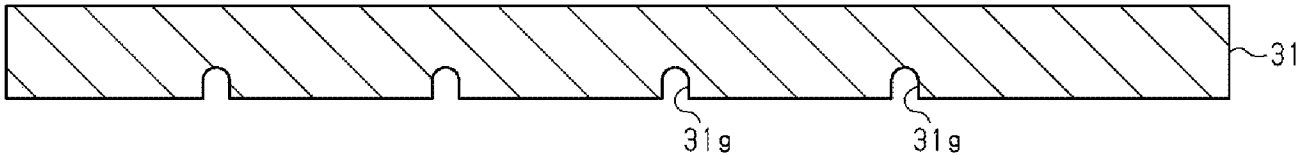

Next, the resist layers 72 and 73 are peeled off by a peel-off solution. Thereby, as shown in FIG. 5D, the metal layer 31 having the grooves 31*g* in the lower face can be formed.

Figure 6A:
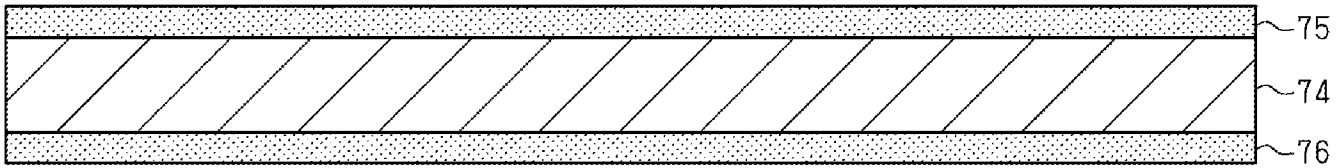
FIGS. 6A to 6D are schematic sectional views showing the manufacturing method of the loop heat pipe of one embodiment.

Next, in a process shown in FIG. 6A, a flat plate-like metal sheet 74 is prepared. The metal sheet 74 is a member that finally becomes the metal layer 32 (refer to FIG. 2A). The metal sheet 74 is made of, for example, copper, stainless steel, aluminum, a magnesium alloy, or the like. A thickness of the metal sheet 74 may be set to about 50 μm to 200 μm, for example.

Subsequently, a resist layer 75 is formed on an upper face of the metal sheet 74, and a resist layer 76 is formed on a lower face of the metal sheet 74. As the resist layers 75 and 76, for example, a photosensitive dry film resist or the like can be used.

Figure 6B:
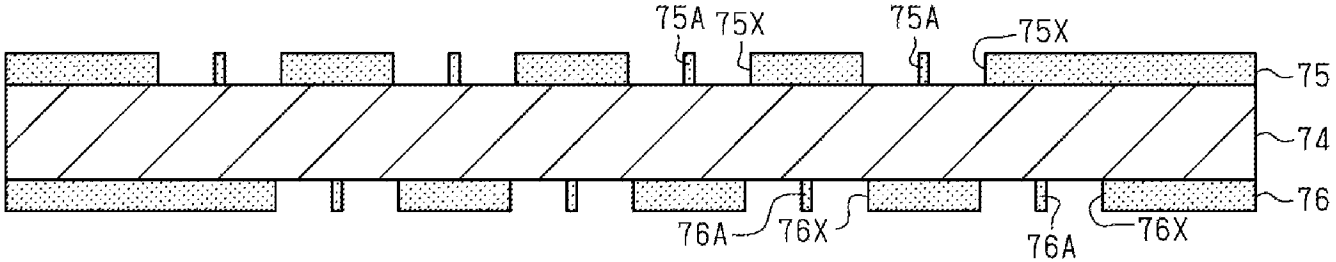

Next, in a process shown in FIG. 6B, the resist layer 75 is exposed and developed to form opening portions 75X for selectively exposing the upper face of the metal sheet 74. Similarly, the resist layer 76 is exposed and developed to form opening portions 76X for selectively exposing the lower face of the metal sheet 74. The opening portions 75X are formed to correspond to the bottomed holes 40 shown in FIG. 2A. The opening portions 76X are formed to correspond to the bottomed holes 50 shown in FIG. 2A. The resist layer 75 has a resist pattern 75A that covers the upper face of the metal sheet 74 at portions where the convex portions 41 shown in FIG. 2B are formed. The resist pattern 75A is provided in the opening portions 75X. The resist layer 76 has a resist pattern 76A that covers the lower face of the metal sheet 74 at portions where the convex portions 51 shown in FIG. 2B are formed. The resist pattern 76A is provided in the opening portions 76X.

Figure 6C:
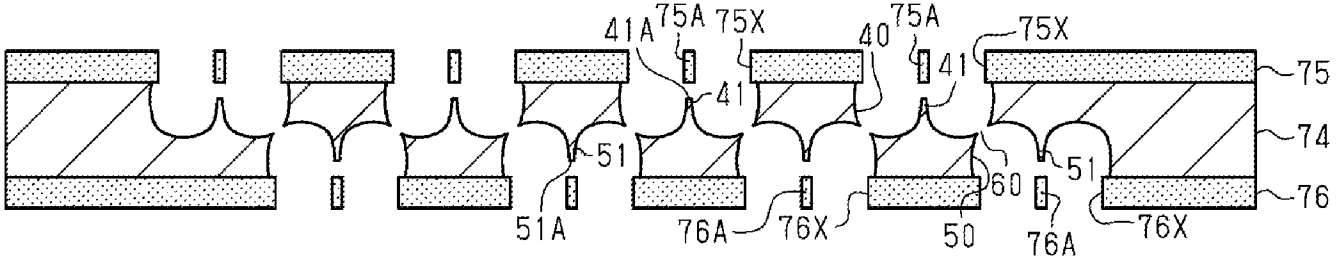

Next, in a process shown in FIG. 6C, the metal sheet 74 exposed from the resist layer 75 is etched from the upper face-side of the metal sheet 74, and the metal sheet 74 exposed from the resist layer 76 is etched from the lower face-side of the metal sheet 74. By the resist pattern 75A and the opening portions 75X, bottomed holes 40 each having a convex portion 41 are formed in the upper face of the metal sheet 74. At this time, a distal end (here, an upper end) of the convex portion 41 is thinned, so that the convex portion 41 is formed at a position where a distal end face 41A of the convex portion 41 is further recessed downward than the upper face of the metal sheet 74. In addition, by the resist pattern 76A and the opening portions 76X, bottomed holes 50 each having a convex portion 51 are formed in the lower face of the metal sheet 74. At this time, a distal end (here, a lower end) of the convex portion 51 is thinned, so that the convex portion 51 is formed at a position where a distal end face 51A of the convex portion 51 is further recessed upward than the lower face of the metal sheet 74. The bottomed hole 40 and the bottomed hole 50 are formed to partially overlap each other, in plan view; and the bottomed hole 40 and the bottomed hole 50 communicate with each other at the overlapping portion to form a pore 60. The bottomed holes 40 and 50 and the convex portions 41, 51 can be formed by, for example, wet-etching the metal sheet 74 by using the resist layers 75 and 76 as an etching mask. When copper is used as the material of the metal sheet 74, a ferric chloride aqueous solution or a copper chloride aqueous solution can be used as an etching solution.

Figure 6D:
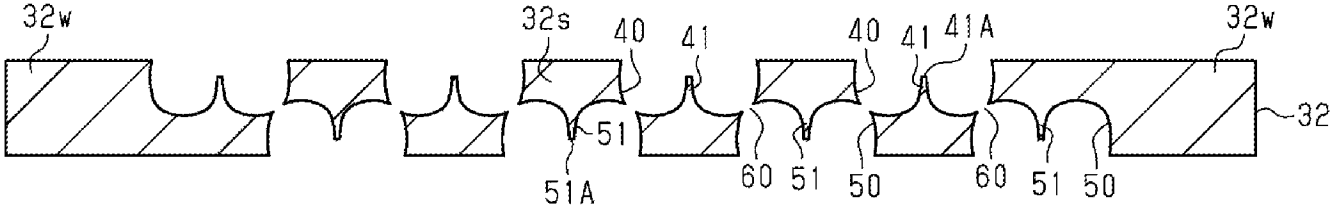

Next, the resist layers 75 and 76 are peeled off by a peel-off solution. Thereby, as shown in FIG. 6D, the metal layer 32 having a pair of wall portions 32*w* and a porous body 32*s* can be formed.

Figure 7A:
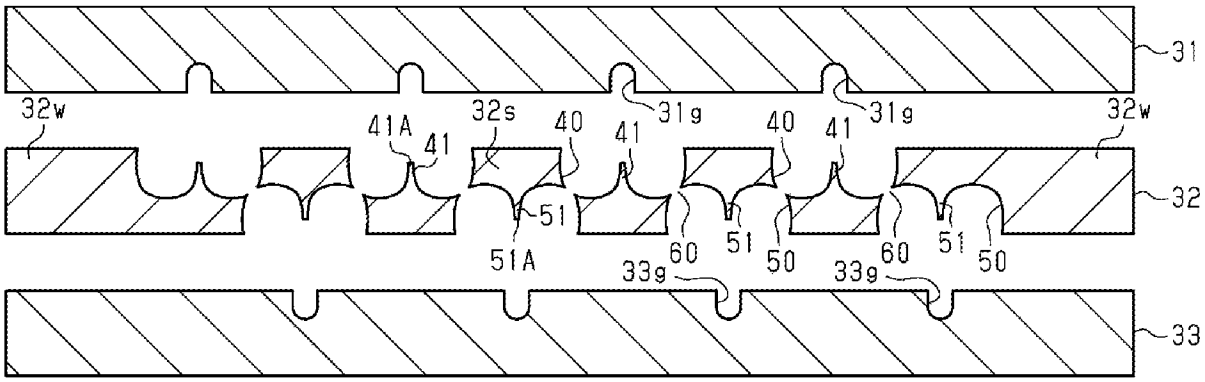
FIGS. 7A and 7B are schematic sectional views showing the manufacturing method of the loop heat pipe of one embodiment.

Subsequently, in a process shown in FIG. 7A, the metal layer 33 is formed by a method similar to the processes shown in FIGS. 5A to 5D. Next, the metal layer 32 is arranged between the metal layer 31 and the metal layer 33.

Figure 7B:
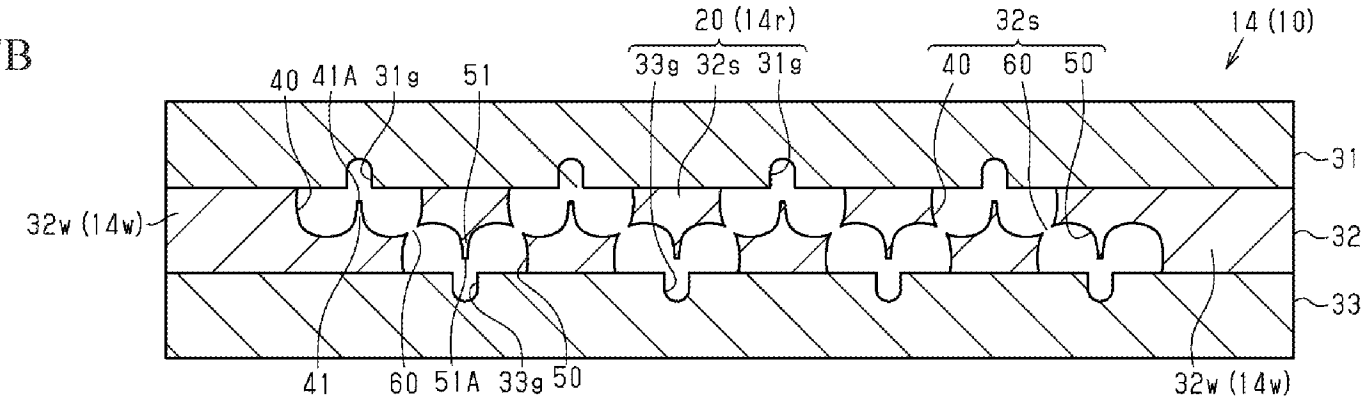

Next, in a process shown in FIG. 7B, the laminated metal layers 31 to 33 are pressed while heating the same to a predetermined temperature (for example, about 900° C.), so that the metal layers 31 to 33 are joined by the solid-phase bonding. Thereby, the metal layers 31, 32 and 33 adjacent to each other in the laminating direction are directly joined.

By the processes described above, a structure where the metal layers 31, 32, and 33 are laminated is formed. Then, the loop heat pipe 10 having the evaporator 11, the vapor pipe 12, the condenser 13, and the liquid pipe 14 shown in FIG. 1 is formed. At this time, the liquid pipe 14 is formed with the porous body 20.

Thereafter, for example, after exhausting the inside of the liquid pipe 14 by using a vacuum pump or the like, the working fluid C is injected into the liquid pipe 14 from an injection port (not shown), and then the injection port is sealed.

Next, the operational effects of the present embodiment are described.

(1) The convex portion 41 is provided in the bottomed hole 40 formed in the metal layer 32 that is the inner metal layer. Thereby, the volume of the bottomed hole 40 can be reduced, as compared to a case where the convex portion 41 is not provided, so that an amount of the working fluid C stored in the bottomed hole 50 can be reduced. Therefore, for example, when a volume expansion occurs as the working fluid C flowing in the liquid pipe 14 undergoes a phase change from a liquid phase to a solid phase, an amount of the volume expansion can be reduced, as compared to the case where the convex portion 41 is not provided. For this reason, it is possible to suppress the metal layer 31, which is the outer metal layer, from being deformed to bulge outward due to the volume expansion of the working fluid C. Therefore, it is possible to suppress the metal layer 31 from peeling from the metal layer 32. For example, even in a case where an electronic device M1 having the loop heat pipe 10 is used in an environment such as a cold region where an ambient temperature is lower than a freezing point of the working fluid C and the working fluid C of the liquid phase freezes and undergoes freezing and expansion, it is possible to suppress the metal layer 31 from peeling from the metal layer 32.

(2) The convex portion 51 is provided in the bottomed hole 50 formed in the metal layer 32 that is the inner metal layer. Thereby, the volume of the bottomed hole 50 can be reduced, as compared to a case where the convex portion 51 is not provided, so that an amount of the working fluid C stored in the bottomed hole 50 can be reduced. Therefore, for example, when a volume expansion occurs as the working fluid C flowing in the liquid pipe 14 undergoes a phase change from a liquid phase to a solid phase, an amount of the volume expansion can be reduced, as compared to the case where the convex portion 51 is not provided. For this reason, it is possible to suppress the metal layer 33, which is the outer metal layer, from being deformed to bulge outward due to the volume expansion of the working fluid C. Therefore, it is possible to suppress the metal layer 33 from peeling from the metal layer 32.

(3) The grooves 31*g* and 33*g* configured to communicate the plurality of adjacent bottomed holes 40 and 50 are provided in the metal layers 31 and 33, and the inner metal layer is configured by only the metal layer 32 of a single layer. By forming the grooves 31*g* and 33*g*, even when the inner metal layer is formed by a single-layer structure, the space formed by communicating the bottomed holes 40 and 50, the pores 60 and the grooves 31*g* and 33*g* can be three-dimensionally expanded. Therefore, the inner metal layer can be configured by only the metal layer 32 of a single layer, and the liquid pipe 14 can be configured by the three metal layers 31 to 33. Thereby, the liquid pipe 14 can be made thin. Further, the loop heat pipe 10 can be made thin.

(4) The convex portion 41 is provided at the center of the plane of the bottomed hole 40, and the groove 31*g* is formed to overlap the convex portion 41, in plan view. For this reason, the groove 31*g* is formed to overlap the center of the bottomed hole 40, in plan view. Thereby, even when the position of the groove 31*g* slightly deviates from a target position due to a manufacturing error or the like, for example, the groove 31*g* can be favorably formed to communicate with the bottomed hole 40.

(5) The distal end of the convex portion 41 is provided with the distal end face 41A formed into a flat face. According to this configuration, the volume of the convex portion 41 can be increased, as compared to a case where the distal end of the convex portion 41 is formed in a needle shape, so that the volume of the bottomed hole 40 can be reduced. Thereby, the amount of the working fluid C stored in the bottomed hole 40 can be reduced, and the amount of volume expansion of the working fluid C can be reduced.

Other Embodiments

The above embodiment can be changed and implemented, as follows. The above embodiment and the following modified examples can be implemented in combination with each other within a technically consistent range.

Figure 8:
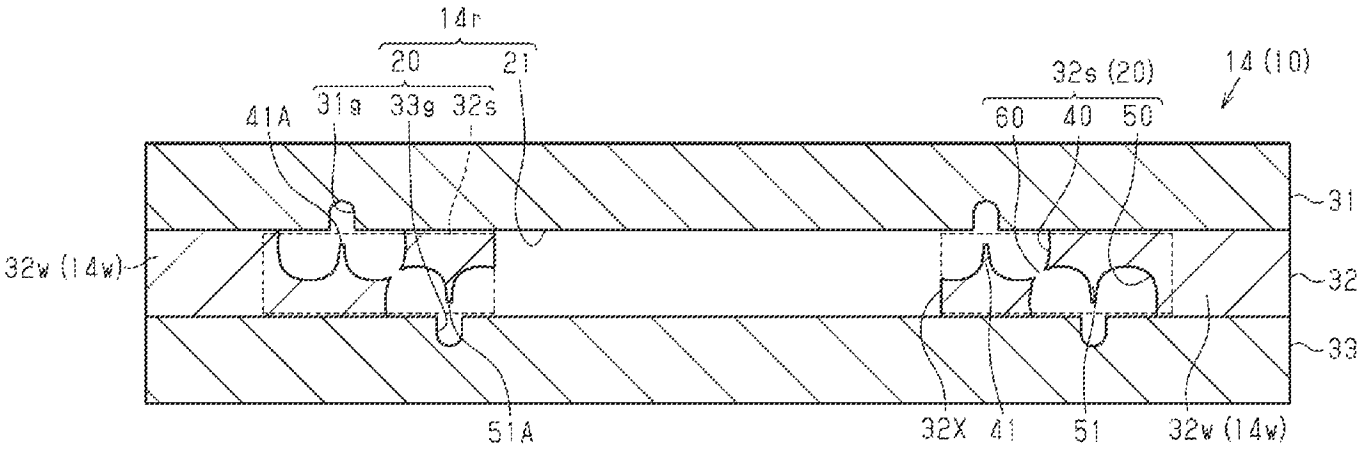
FIG. 8 is a schematic sectional view showing a loop heat pipe of a modified embodiment.

As shown in FIG. 8, the liquid pipe 14 may be provided with the porous body 20 and a flow channel 21 (first flow channel). The liquid pipe 14 of the present modified example has a pair of pipe walls 14*w*, a pair of porous bodies 20 formed to be continuous with the pair of pipe walls 14*w*, and a flow channel provided between the pair of porous bodies 20. In the liquid pipe 14 of the present modified example, the flow channel 14*r* of the liquid pipe 14 is configured by the flow channel of the porous body 20 and the flow channel 21. Note that, the porous body 20 is configured by the porous body 32*s* of the metal layer 32 and the grooves 31*g* and 33*g* of the metal layers 31 and 33, like the above embodiment.

A sectional area of the flow channel 21 is formed to be larger than a sectional area of the flow channel of the porous body 20, for example. The flow channel 21 is configured by a through-hole 32X penetrating through the metal layer 32, which is the inner metal layer, in the thickness direction. For example, the flow channel 21 is configured to communicate with the flow channel of the porous body 20. For example, the through-hole 32X is configured to communicate with at least one of the bottomed holes 40 and 50 of the metal layer 32.

Also in this case, the convex portions 4*l* and 51 are provided in the bottomed holes 40 and 50, respectively.

Figure 9:
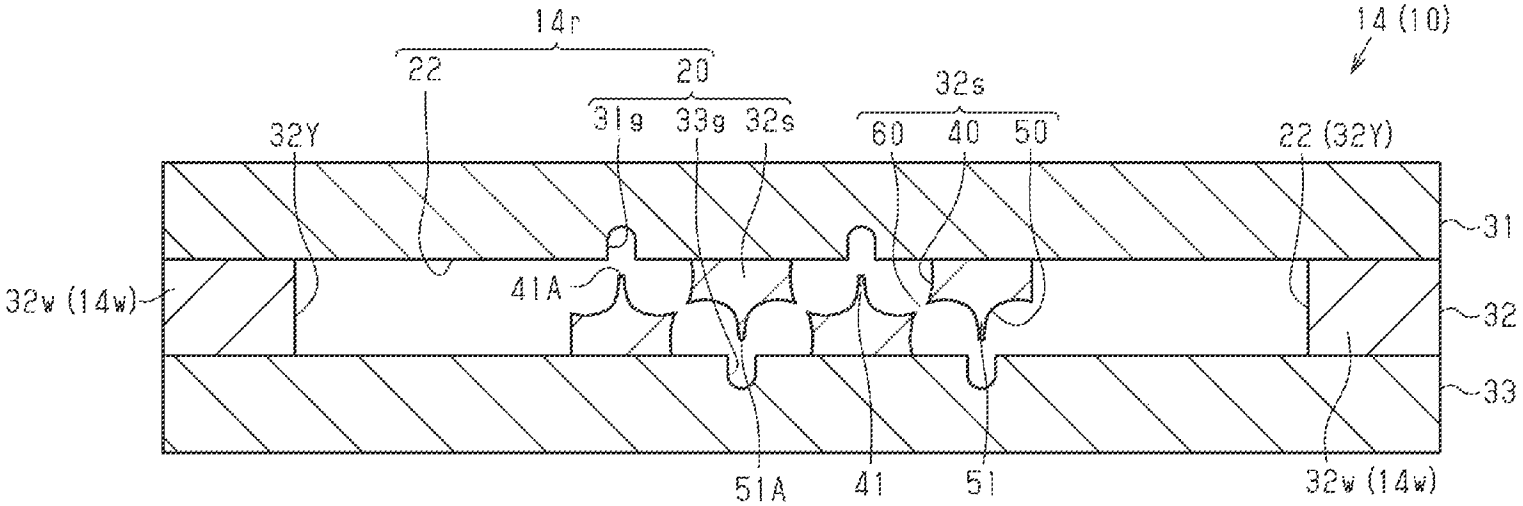
FIG. 9 is a schematic sectional view showing a loop heat pipe of a modified embodiment.

As shown in FIG. 9, the liquid pipe 14 may be provided with the porous body 20 and a plurality of flow channels 22

(first flow channel). The liquid pipe 14 of the present modified example has a pair of pipe walls 14*w*, a porous body 20 provided apart from each pipe wall 14*w*, and two flow channels 22 provided between each pipe wall 14*w* and the porous body 20. In the liquid pipe 14 of the present modified example, the flow channel 14*r* of the liquid pipe 14 is configured by the flow channel of the porous body 20 and the two flow channels 22. The porous body 20 of the present modified example is provided at a central portion in the width direction of the liquid pipe 14. The porous body 20 is provided apart from the pipe wall 14*w* by the flow channel 22. Note that, the porous body 20 is configured by the porous body 32*s* of the metal layer 32 and the grooves 31*g* and 33*g* of the metal layers 31 and 33, like the above embodiment.

A sectional area of each flow channel 22 is formed larger than a sectional area of the flow channel of the porous body 20, for example. Each flow channel 22 is configured by a through-hole 32Y penetrating through the metal layer 32, which is the inner metal layer, in the thickness direction. For example, each flow channel 22 is configured to communicate with the flow channel of the porous body 20. For example, each through-hole 32Y is configured to communicate with at least one of the bottomed holes 40 and 50 of the metal layer 32.

Also in this case, the convex portions 41 and 51 are provided in the bottomed holes 40 and 50, respectively.

In the above embodiment, the porous body 20 including the bottomed holes 40 and 50 having the convex portions 41 and 51 is provided in the liquid pipe 14. However, the present invention is not limited thereto. For example, the porous body 20 may also be provided in the evaporator 11, the steam tube 12 or the condenser 13. For example, the porous body 20 may be provided in at least one of the evaporator 11, the vapor pipe 12, the condenser 13, and the liquid pipe 14. For example, the porous body 20 may also be provided only in the vapor pipe 12.

The shapes of the bottomed holes 40 and 50 and the convex portions 41 and 51 in the porous body 20 of the above embodiment may also be appropriately changed.

Figure 10:
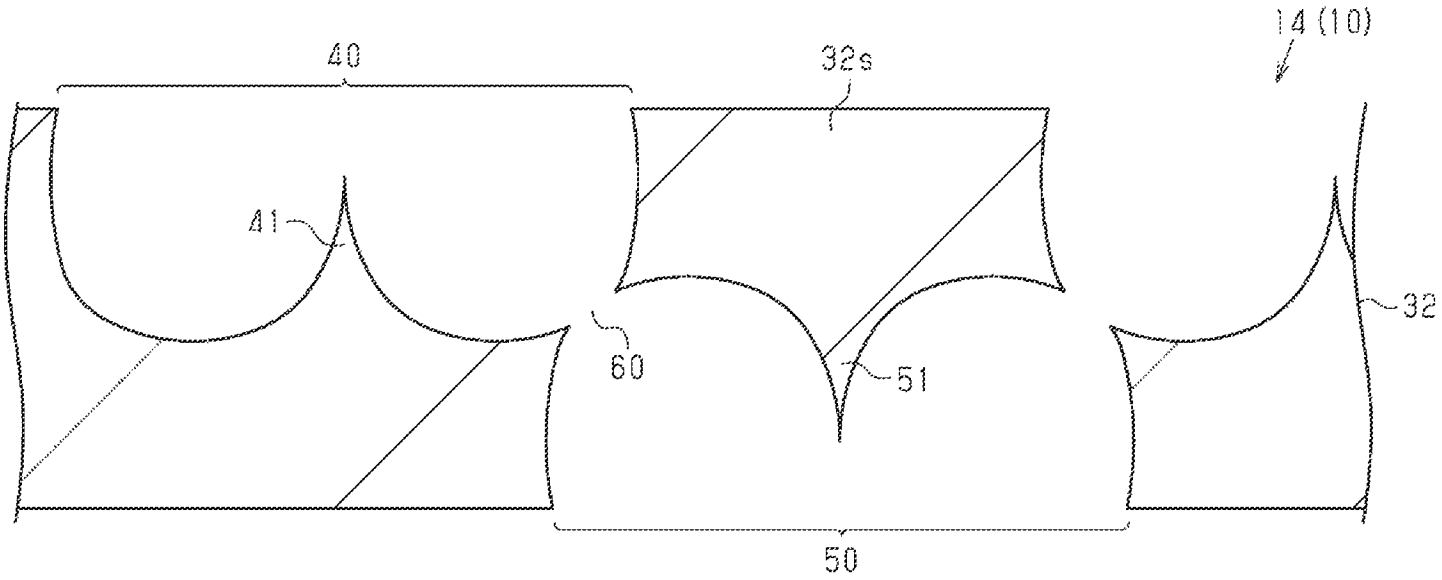
FIG. 10 is an enlarged sectional view of a part of the loop heat pipe of the modified embodiment.

For example, as shown in FIG. 10, the distal end of the convex portion 41 may also be formed into a needle-like pointed shape. Similarly, the distal end of the convex portion 51 may also be formed into a needle-like pointed shape.

Further, in the porous body 32*s*, a convex portion 41 having a needle-shaped distal end and a convex portion 41 having a distal end face 41A formed into a flat face may coexist. Similarly, in the porous body 32*s*, a convex portion 51 having a needle-shaped distal end and a convex portion 51 having a distal end face 51A formed into a flat face may coexist.

In the porous body 20 of the above embodiment, the depth of the bottomed hole 40 provided in the upper face of the metal layer 32 and the depth of the bottomed hole 50 provided in the lower face of the metal layer 32 may be different.

In the above embodiment, the convex portions 41 and 51 are provided in both the bottomed holes 40 and 50. However, the present invention is not limited thereto. For example, the convex portion 41 may also be provided only in the bottomed hole 40 of the bottomed holes 40 and 50. That is, the convex portion 51 may also be omitted. For example, the convex portion 51 may also be provided only in the bottomed hole 50 of the bottomed holes 40 and 50. That is, the convex portion 41 may also be omitted.

In the above embodiment, the convex portions 41 are provided in all the bottomed holes 50. However, the present invention is not limited thereto. For example, the convex portion 41 may be provided in at least one bottomed hole 40 of the plurality of bottomed holes 40.

In the above embodiment, the convex portions 51 are provided in all the bottomed holes 50. However, the present invention is not limited thereto. For example, the convex portion 51 may be provided in at least one bottomed hole 50 of the plurality of bottomed holes 50.

In the above embodiment, a plurality of convex portions 41 may also be provided in one bottomed hole 40.

In the above embodiment, a plurality of convex portions 51 may also be provided in one bottomed hole 50.

In the above embodiment, the inner metal layer is configured by only the metal layer 32 of a single layer. That is, the inner metal layer is formed to have a single layer structure. However, the present invention is not limited thereto. For example, the inner metal layer may also be formed to have a laminated structure where a plurality of metal layers is laminated. In this case, the inner metal layer is configured by a plurality of metal layers laminated between the metal layer 31 and the metal layer 33. Further, each of the plurality of metal layers constituting the inner metal layer has a porous body similar to the porous body 32*s*. Further, if the inner metal layer is configured by a plurality of metal layers, the lower face of the metal layer 31 may not be formed with one or more grooves 31*g*, and the upper face of the metal layer 33 may not be formed with one or more grooves 33*g*.

What is claimed is:

1. A loop heat pipe comprising:

an evaporator that vaporizes a working fluid;

a condenser that condenses the working fluid;

a liquid pipe that connects the evaporator and the condenser to each other;

a vapor pipe that connects the evaporator and the condenser to each other; and a loop-like flow channel that is provided in each of the evaporator, the condenser, the liquid pipe, and the vapor pipe, and through which the working fluid flows, wherein at least one of the evaporator, the condenser, the liquid pipe and the vapor pipe comprises a first outer metal layer, a second outer metal layer, and an inner metal layer that is provided between the first outer metal layer and the second outer metal layer, and the inner metal layer comprises a porous body, wherein the porous body comprises a first bottomed hole formed in one face of the inner metal layer, a second bottomed hole formed in the other face of the inner metal layer, a pore, wherein the first bottomed hole and the second bottomed hole partially communicates with each other through the pore, and a first convex portion provided inside the first bottomed hole, wherein the first convex portion has a proximal end connected to a bottom face of the first bottomed hole and a distal end provided on an opposite side to the proximal end in a thickness direction of the first convex portion, the first convex portion is provided at a center of the first bottomed hole in plan view, and the first convex portion has a side surface connecting the proximal end to the distal end, the side surface being spaced apart from an inner wall of the first bottomed hole, and the distal end of the first convex portion is provided at a position further recessed toward the bottom face of the first bottomed hole than the one face of the inner metal layer.

2. The loop heat pipe according to claim 1, wherein the first outer metal layer is bonded to the one face of the inner metal layer, and the first outer metal layer comprises a first groove communicating with the first bottomed hole.

3. The loop heat pipe according to claim 2, wherein the first groove overlaps with the first convex portion in plan view.

4. The loop heat pipe according to claim 1, wherein the porous body further comprises a second convex portion provided inside the second bottomed hole, the second convex portion comprises a proximal end connected to a bottom face of the second bottomed hole and a distal end provided on an opposite side to the proximal end in a thickness direction of the second convex portion, and wherein the distal end of the second convex portion is provided at a position further recessed toward the bottom face of the second bottomed hole than the other face of the inner metal layer.

5. The loop heat pipe according to claim 4, wherein:

the inner metal layer is a single inner metal layer;

the second outer metal layer is bonded to the other face of the inner metal layer; and the second outer metal layer comprises a second groove communicating with the second bottomed hole.

6. The loop heat pipe according to claim 5, wherein:

the second groove overlaps with the second convex portion, in plan view.

7. The loop heat pipe according to claim 4, wherein:

the second convex portion is provided at a center of the second bottomed hole in plan view, and the second convex portion has a side surface connecting the proximal end of the second convex portion to the distal end of the second convex portion, the side surface of the second convex portion being spaced apart from an inner wall of the second bottomed hole.

8. The loop heat pipe according to claim 1, wherein:

a distal end of the first convex portion has a distal end face formed into a flat face.

9. The loop heat pipe according to claim 1, wherein:

the liquid pipe comprises the first outer metal layer, the second outer metal layer, and the inner metal layer;

the inner metal layer of the liquid pipe comprises the porous body and a first flow channel that is larger in a sectional area than a flow channel configured by the porous body; and the first bottomed hole and the second bottomed hole communicate with the first flow channel.

* * * * *